US005364023A

United States Patent [19]

Vollers

[11] Patent Number: 5,364,023

[45] Date of Patent: Nov. 15, 1994

[54] PRODUCE BOX

[76] Inventor: Gary L. Vollers, 11471 Tampa Ave., #149, Northridge, Calif. 91326

[21] Appl. No.: 130,872

[22] Filed: Oct. 4, 1993

[51] Int. Cl.[5] ..... B65D 5/32

[52] U.S. Cl. ..... 229/199; 206/503; 229/23 R; 229/916; 229/919

[58] Field of Search ..... 206/503; 220/6, 7; 229/23 R, 199, 915, 919, 916; 217/36, 52

[56] References Cited

U.S. PATENT DOCUMENTS

| | | | |
|---|---|---|---|
| 1,699,130 | 1/1929 | Anderson | 217/36 |
| 2,072,672 | 3/1937 | Frost . | |
| 2,414,659 | 1/1947 | Montague | 229/916 |
| 2,551,814 | 5/1951 | Rushing et al. . | |
| 2,633,285 | 3/1953 | Kells . | |
| 2,736,487 | 2/1956 | George . | |
| 3,010,638 | 11/1961 | Forrer . | |
| 3,373,921 | 3/1968 | Crane | 229/23 R |
| 3,623,650 | 11/1971 | Watts . | |
| 3,632,037 | 1/1972 | Webb et al. | 229/23 R |
| 3,713,579 | 1/1973 | Chaffers . | |
| 3,905,478 | 9/1975 | Peterson et al. | 217/52 |
| 3,905,541 | 9/1975 | Paxton . | |
| 3,921,896 | 11/1975 | Ishimura . | |
| 4,187,977 | 2/1980 | Boykin et al. . | |
| 4,230,233 | 10/1980 | Orr | 229/23 R |
| 4,245,773 | 1/1981 | Stollberg . | |
| 4,251,006 | 2/1981 | Smith | 217/36 |
| 4,277,015 | 7/1981 | Crane . | |
| 4,291,830 | 9/1981 | Sorensen . | |
| 4,389,013 | 6/1983 | Hall et al. . | |
| 4,482,074 | 11/1984 | Calley | 220/6 |
| 4,685,610 | 8/1987 | Carter et al. | 229/916 |
| 4,762,270 | 8/1988 | Stoll et al. . | |
| 4,763,833 | 8/1988 | Stoll . | |
| 4,828,894 | 5/1989 | Taylor . | |
| 4,911,356 | 3/1990 | Townsend et al. . | |
| 4,948,039 | 8/1990 | Amatangelo . | |
| 4,993,623 | 2/1991 | Kelly et al. | 229/23 R |
| 5,038,998 | 8/1991 | Morris et al. . | |
| 5,116,290 | 5/1992 | Ross | 229/23 R |
| 5,190,213 | 3/1993 | Horwitz . | |

FOREIGN PATENT DOCUMENTS

| | | | |
|---|---|---|---|
| 2449605 | 9/1980 | France | 229/919 |

OTHER PUBLICATIONS

The Wiley Encyclopedia of Packaging Technology, John Wiley & Sons, pp. 341–346 (1986).

*Primary Examiner*—Gary E. Elkins
*Attorney, Agent, or Firm*—William W. Haefliger

[57] ABSTRACT

A box structure comprising box side walls, a bottom wall, and two end walls, the two end walls each having substantially greater thickness than the side walls and the bottom wall. The end walls have peripheral edges, the bottom wall and the side walls have edge portions overlapping certain of the peripheral edges of the end walls. There are fasteners attaching the bottom wall and the side wall edge portions to the end wall peripheral edges, the fasteners penetrating through the bottom wall and the side wall edge portions and into the end walls via the certain peripheral edges thereof. The end walls consist essentially of cellular foamed polyethylene, which has specific gravity between 0.800 and 0.940. The bottom wall and the side walls form a continuous strip, which is folded to fit against the certain peripheral edges of the end walls, the certain peripheral edges being flat. The fasteners comprise nails driven into the cellular polyethylene.

8 Claims, 3 Drawing Sheets

PRODUCE BOX

BACKGROUND OF THE INVENTION

This invention relates generally to box structures, as for example are usable for produce packaging, and more particularly to boxes having certain relatively thinner walls fastened, as by nails, to relatively thicker walls, to provide open box tops which then may be rapidly closed by lids removably attached to the thicker end walls.

Box structure or containers of the above type, as for produce such as grapes (for example), have been utilized employing wooden end walls which are relatively thick, to facilitate nailing, as referred to. However, such boxes must be extremely inexpensive, yet sturdy, whereas the cost of wood has become prohibitive. Efforts have been made, accordingly, to produce and use boxes made of paperboard; however, such boxes tend to entirely collapse when a number of filled boxes are stacked one on top of another. There is need for improvements in construction of such boxes, enabling use of other less expensive materials.

Boxes made at least in part of plastic material are not considered satisfactory, due to excessive weight of plastic walls, and tendency of such walls to develop cracks when nails are driven into the edges of walls, as are required in such boxes. There is need for an improved box construction meeting the above need, and obviating the described problems, as well as other problems incorporated in this area.

SUMMARY OF THE INVENTION

It is a major object of the invention to provide an improved box construction meeting the above needs. Basically, the improved structure comprises:

a) box side walls, bottom wall, and two end walls, the two end walls each having substantially greater thickness than the side walls, and the bottom wall, b) the end walls having peripheral edges, the bottom wall and side walls having edge portions overlapping certain of the peripheral edges of the end walls, c) there being fasteners attaching the bottom wall and side wall edge portions to the end wall peripheral edges, the fasteners penetrating through the bottom wall and side wall edge portions and into the end walls via the certain peripheral edges thereof, d) the end walls consisting essentially of lightweight, cellular synthetic resin.

As will be seen, the use of cellular synthetic resin, or plastic, prevents crack growth when nails are driven into the end walls; while at the same time providing a lightweight, low cost, high strength end wall material. Such material may advantageously consist of foamed, low cost, polyethylene molded to have lightweight construction. Such end walls are reusable, as will be seen. Typically, the bottom wall and side walls form a continuous strip which is folded to fit against the certain peripheral edges of the end walls, the certain peripheral edges being flat; and such folded walls may form a continuous strip comprising heavy paperboard.

Another object is to provide box plastic end walls, as referred to, which define inner sides forming the box interior, and outer sides facing the box exterior, the end walls forming recesses between their inner and outer sides, and in spaced relation to the fasteners. Such end walls may typically and advantageously form, in part, a regular grid pattern about the recesses, and spaced from those edge portions which receive nail penetration. The gridwork recesses typically extend through the end walls between the inner and outer sides, and throughout medial extents of the end walls spaced from all edge portions of the molded plastic end walls, providing an exceptionally strong, yet lightweight construction, which is nailable and prevents crack growth. Corners of the end walls may be beveled, as will be seen.

These and other objects and advantages of the invention, as well as the details of an illustrative embodiment, will be more fully understood from the following specification and drawings, in which:

DRAWING DESCRIPTION

DETAILED DESCRIPTION

In FIGS. 1–4, the produce box structure 10 includes box side walls 11*a* and 11*c*, box bottom wall 11*b* and box end walls 12 and 13, which are alike. Walls 11*a*, 11*b* and 11*c* preferably have the same thickness $t_1$ which is substantially less than the overall thickness $t_2$ of each of the end walls. Thickness $t_2$ is substantially greater than $t_1$, and these may have the following values:

$t_1 \approx 5/32$ inch (between 4/32 & 6/32)

$t_2 \approx 19/32$ inch (between 18/32 & 20/32)

Figure 1:
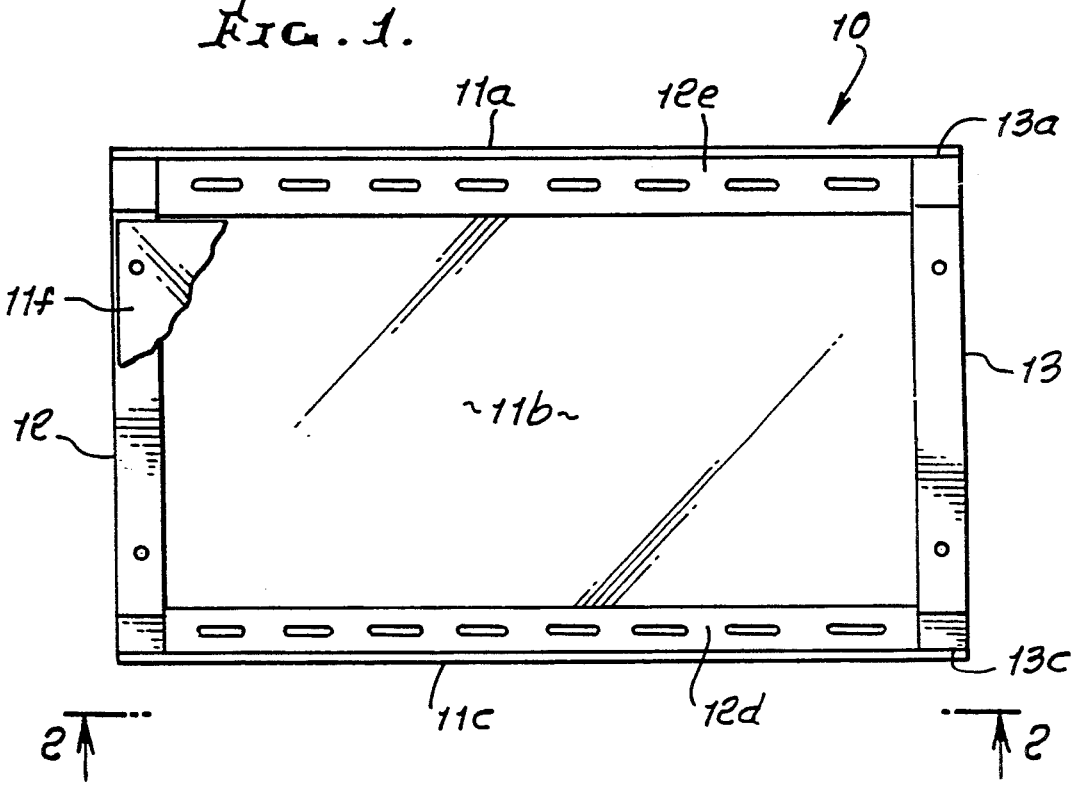
FIG. 1 is a top plan view of a produce box incorporating one form of the invention.
Figure 2:
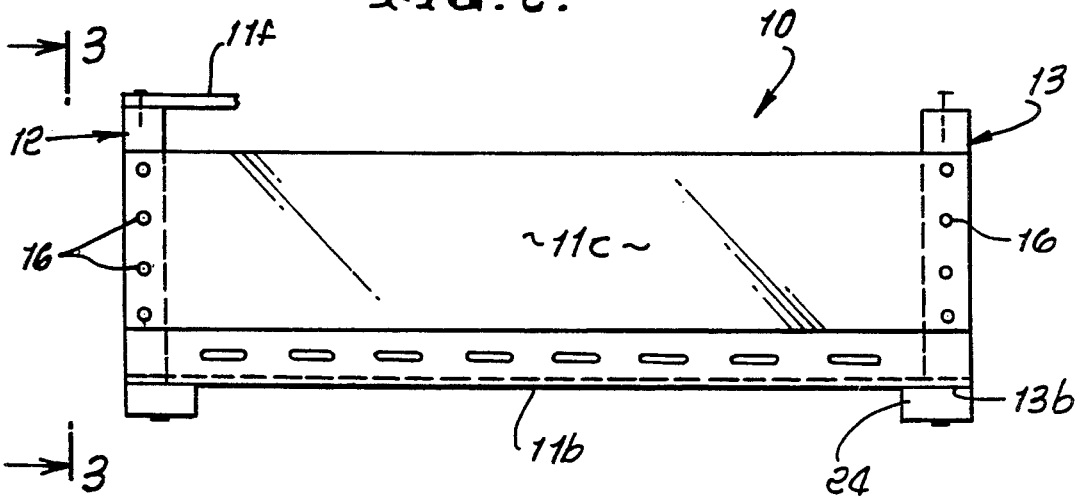
FIG. 2 is an elevation taken on lines 2—2 of FIG. 1.
Figure 3:
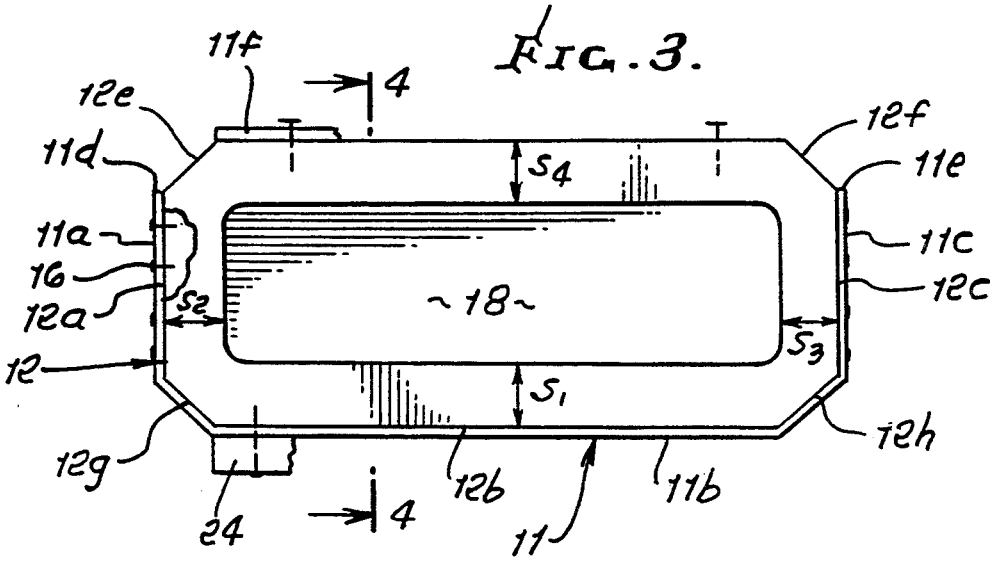
FIG. 3 is an end elevation taken on lines 3—3 of FIG. 2.
Figure 8:
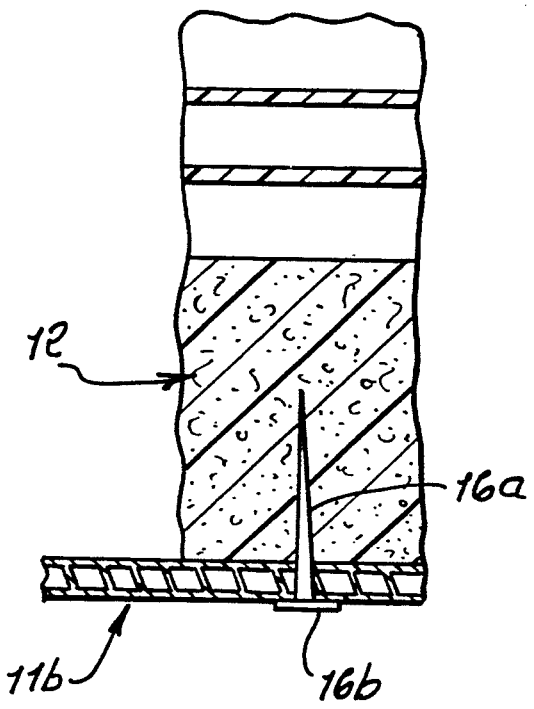
FIG. 8 is an enlarged section showing nailing detail.

Walls 11*a*,11*b* and 11*c* preferably form a continuous rectangular strip or sheet 11 folded to have its opposite edge portions overlap and fit flatly against peripheral edges 12*a*, 12*b* and 12*c*, and 13*a*, 13*b* and 13*c* of the end walls. Opposite ends of the strip 11 are indicated at 11*d* and 11*e*. Corners of the end walls 12 and 13 are similarly beveled, as seen at 12*g–h*, whereby strip 11 also fits flatly against beveled edges 12*g* and 12*h*, as seen in FIG. 3. Strip 11 typically consists of paperboard, and may be internally reinforced, as by means of very thin, flat wooden sheets, as seen at 11*i* in FIG. 8. Alternatively, the reinforcement sheet may consist of corrugated paperboard. See also angled edges 12*c–*12*f* of the end walls.

In accordance with an important aspect of the invention, the end walls 12 and 13 consist of cellular synthetic resin, as for example, and preferably, lightweight, foamed, low cost polyethylene. The specific gravity is between 0.800 and 0.940.

Fasteners indicated at 16 are employed to attach the edge portions of the side and bottom walls 11*a–*11*c* to the end wall peripheral edges 12*a–*12*c* and 13*a–*13*c*, as referred to above. Such fasteners typically comprise nails having shanks 16*a* and heads 16*b*. The nail shanks frictionally penetrate the cellular plastic material (see FIG. 8), and any cracks formed during forcible nailing are interrupted by the cells of the foamed plastic to stop their spreading. Also, the cellular construction facilitates such nailing, as contrasted with solid plastic which would prevent satisfactory nailing.

Figure 4:
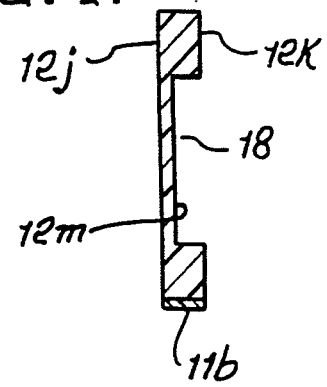
FIG. 4 is a section taken in elevation on lines 4—4 of FIG. 3.

In accordance with another feature of the invention, the plastic end walls are molded to form recesses 18 sunk into the outer sides of the end walls, as seen in FIGS. 3 and 4. Recesses 18 are elongated lengthwise of the end walls, and spaced inwardly of edges of the end walls receiving nails, as referred to. See for example spacings $s_1$–$s_4$ in FIG. 3. Such recesses decrease the weight of the box, and save plastic material. Inner and outer sides of end wall 12 appear at 12*j* and 12*k* in FIG. 4. The inner wall 12*m* of the recess 18 is closer to wall 12*j* than to wall 12*k*.

Figure 6:
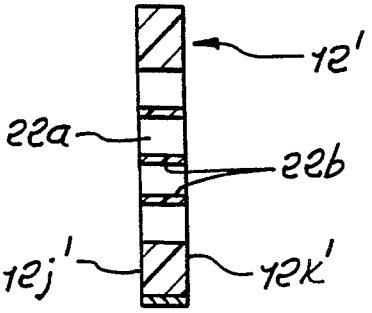
FIG. 6 is a section taken in elevation on lines 6—6 of FIG. 5.
Figure 5:
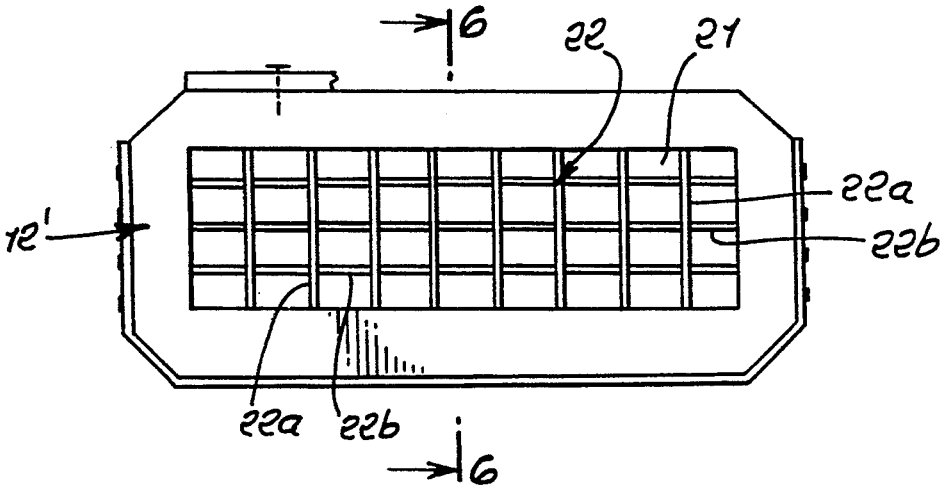
FIG. 5 is an end elevation showing a box incorporating a modified plastic end wall having a grid construction.

FIGS. 5 and 6 show an alternative and preferable form of recessing 21 in the molded plastic end wall 12' which has foamed construction, as referred to above. Such recessing is formed by a plastic grid 22 integral with the end wall 12', with vertically extending, laterally spaced thin webs 22*a*, and horizontally extending, vertically spaced flat webs 22*b*, webs 22*a* intersecting webs 22*b*, as shown. The recesses 21 extend entirely through the end wall between its inner and outer sides 12'*j* and 12'*k*. See FIG. 6. Such recesses substantially lighten the overall weight of the box construction, yet maintain end wall strength support for stacking of a large number of fruit or produce-filled boxes without collapse.

Figure 7:
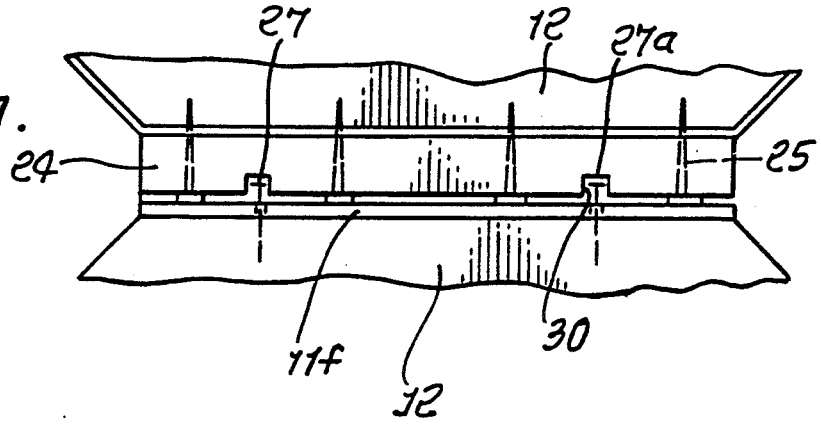
FIG. 7 is a fragmentary elevation illustrating box stacking.

FIG. 7 shows such stacking, with a slat 24 attached by nails 25 to the bottom of a box and extending under its plastic end wall 12, receiving the heads of the nails 27 that are driven downwardly into the upper extent of plastic end wall 12 of the next below box. Heads 27 are received in recesses 30 to maintain the upper and lower boxes in alignment.

In this regard, nails 27 serve to loosely retain a box lid 29 to the top of the end wall upper edges, and also protrude upwardly to fit in box stack alignment notches 30 formed in slat 24.

I claim:

1. In a box structure, the combination comprising a) box side walls, a bottom wall, and two end walls, said two end walls each having substantially greater thickness than said side walls, and said bottom wall, b) the end walls having peripheral edges, said bottom wall and side walls having edge portions overlapping certain of said peripheral edges of the end walls, c) there being fasteners attaching said bottom wall and side wall edge portions to said end wall peripheral edges, said fasteners penetrating through said bottom wall and side wall edge portions and into said end walls via said certain peripheral edges thereof, d) said end walls consisting essentially of cellular foamed polyethylene, e) said bottom wall and side walls forming a continuous strip which is folded to fit against said certain peripheral edges of said end walls, said certain peripheral edges being flat, said end walls being generally rectangular and having beveled corners flatly engaged by said continuous strip, said strip comprising paperboard and including two parallel sheets and a corrugated sheet located therebetween and bonded thereto, f) there being recesses in said end walls in spaced relation to said fasteners, g) said fasteners comprising nails driven into portions of said cellular polyethylene free of said recesses, said portions being substantially solid, said nails having shanks which throughout their lengths in said portions are entirely and closely surrounded by said cellular polyethylene.

2. The combination of claim 1 wherein said strip has thickness between 4/32 and 6/32 inch and said end walls have overall thickness between 18/32 and 20/32 inches.

3. The combination of claim 1 wherein there is an interior and an exterior of the box structure, said end walls define inner sides facing said interior, and outer sides facing said exterior.

4. The combination of claim 3 wherein said end walls form a regular grid pattern about said recesses.

5. The combination of claim 4 wherein said recesses extend through the end walls between said inner and outer sides.

6. The combination of claim 1 wherein said box has an interior, and said box side walls have parts thereof angled to overlap said interior.

7. In a box structure, the combination comprising a) box side walls, bottom wall, and two end walls, said two end walls each having substantially greater thickness than said side walls, and said bottom wall, b) the end walls having peripheral edges, said bottom wall and side walls having edge portions overlapping certain of said peripheral edges of the end walls, c) there being fasteners attaching said bottom wall and side wall edge portions to said end wall peripheral edges, said fasteners penetrating through said bottom wall and side wall edge portions and into said end walls via said certain peripheral edges thereof, d) said end walls consisting essentially of lightweight, cellular foamed polyethylene, e) said bottom wall and side walls forming a continuous strip which is folded to fit against said certain peripheral edges of said end walls, said certain peripheral edges being flat, said end walls being generally rectangular and having beveled corners flatly engaged by said continuous strip, said strip comprising paperboard and including two parallel sheets and a corrugated sheet located therebetween and bonded thereto, f) there being recesses in said end walls in spaced relation to said fasteners, g) said fasteners comprising nails driven into portions of said cellular polyethylene free of said recesses, said portions being substantially solid, said nails having shanks which throughout their lengths in said portions are entirely and closely surrounded by said cellular polyethylene.

h) and including a top cover on the box structure and nails driven through the top cover and into end wall peripheral edges which face upwardly, the nails having heads spaced above said top cover, a support slat overlying said cover, and alignment notches in the slat loosely receiving said nail heads.

8. The combination of claim 7 including another box structure like that of claim 1, and having its bottom wall attached to the slat, at the upper side thereof.

* * * * *